United States Patent [19]

Hansson et al.

[11] 4,191,493

[45] Mar. 4, 1980

[54] METHOD FOR THE PRODUCTION OF A CAVITY LIMITED BY A FLEXIBLE MATERIAL

[75] Inventors: Knut Hansson, Malmo; Lars Larson, Falsterbo, both of Sweden

[73] Assignee: Aktiebolaget Platmanufaktur, Malmö, Sweden

[21] Appl. No.: 815,840

[22] Filed: Jul. 14, 1977

[51] Int. Cl.[2] ..... E21D 11/00

[52] U.S. Cl. ..... 405/150; 405/154; 405/155; 156/294

[58] Field of Search ..... 405/133, 146, 155, 154, 405/184; 138/98, 97; 29/234, 451, 235; 156/94, 156, 294; 175/64

[56] References Cited

U.S. PATENT DOCUMENTS

| | | | |
|---|---|---|---|
| 768,477 | 8/1904 | McKinley | 138/98 X |
| 2,794,758 | 6/1957 | Harper et al. | 156/294 X |
| 3,422,631 | 1/1969 | Silverman | 405/155 |
| 3,494,813 | 2/1970 | Lawrence et al. | 156/294 X |
| 3,500,819 | 3/1970 | Silverman | 156/294 X |

*Primary Examiner*—Dennis L. Taylor

*Attorney, Agent, or Firm*—Hane, Roberts, Spiecens & Cohen

[57] ABSTRACT

A method for producing a tubular length of material which can line the interior of a bore comprising providing a magazine having a substantial length of tubular material radially wound on itself in a number of overlapping layers, pulling one end of the tubular material from the magazine and closing this end to form a tubular cavity within the portion of the tubular material pulled from the magazine. The magazine or the closed end of the tubular cavity can be supported at the bottom of the bore and a pressure medium can be supplied to the cavity to unwind the material from the magazine while permitting relative movement between the magazine and the end of the tubular material. After the bore has been lined with the material, a substance can be supplied therein which will effectively sealed from the bore by the tubular material. The magazine can be mounted on a hollow guide which serves both to supply the pressure medium to the cavity and to introduce the substance into the lined bore. Additionally, in the case where the magazine travels through the bore, the guide can serve as a slidable and rotatable support for the magazine.

8 Claims, 28 Drawing Figures

FIG. 5
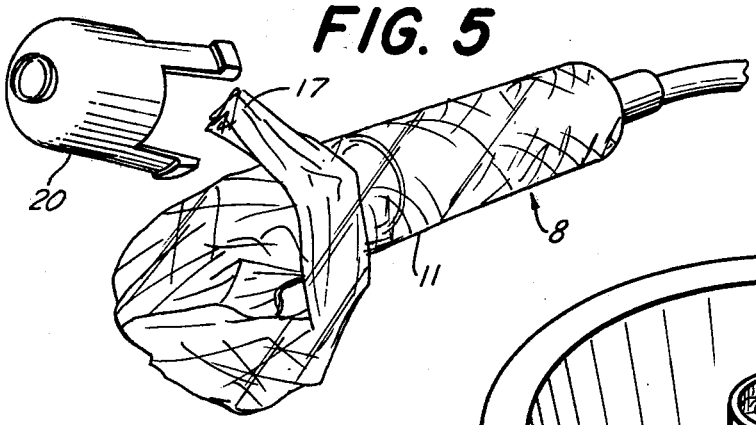
FIG. 7
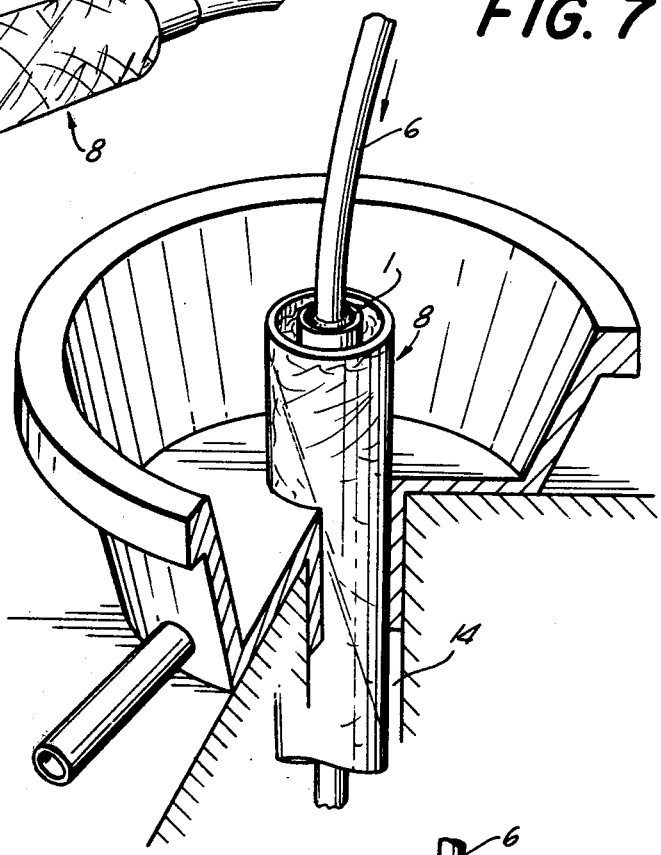
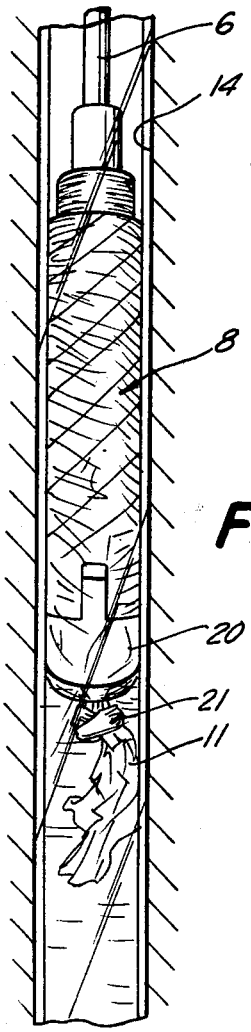
FIG. 8
FIG. 9
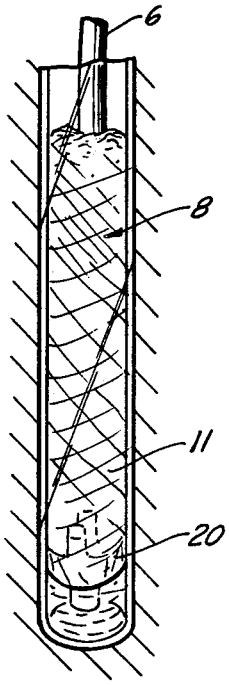

FIG. 6D
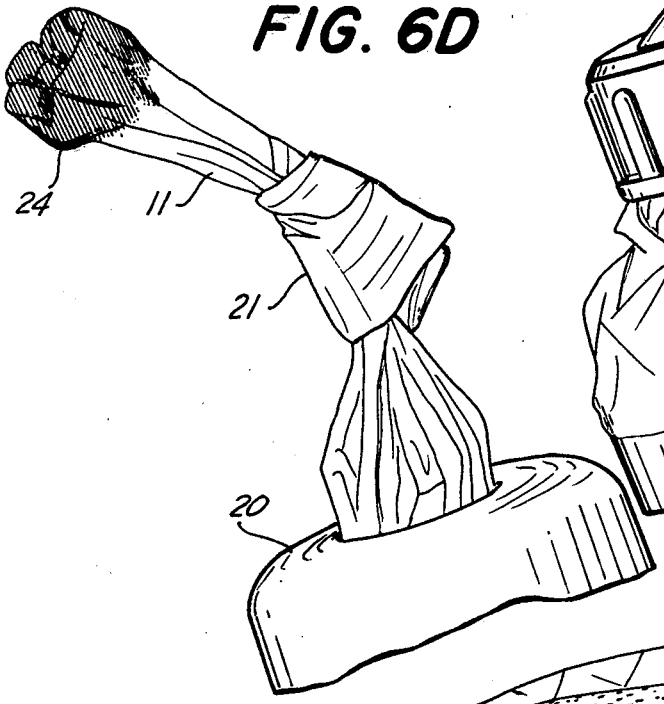
FIG. 6E
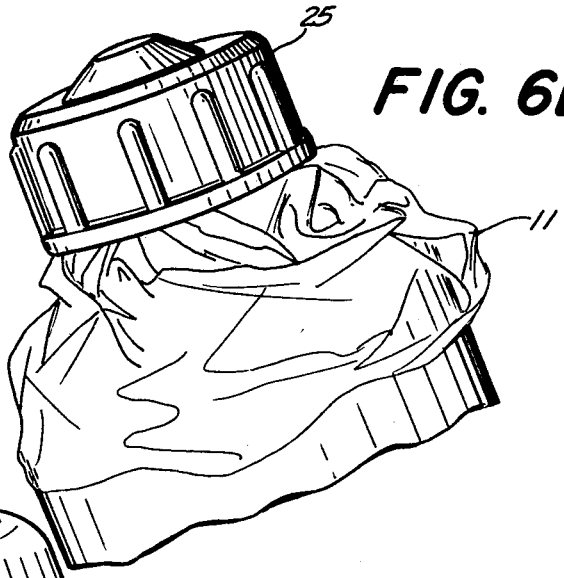
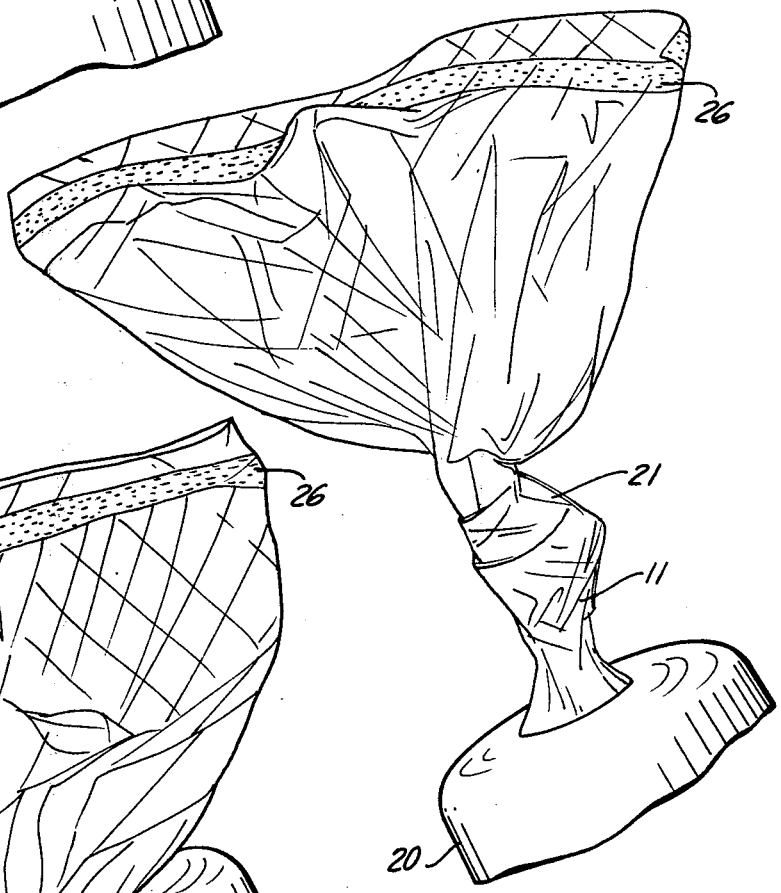
FIG. 6F
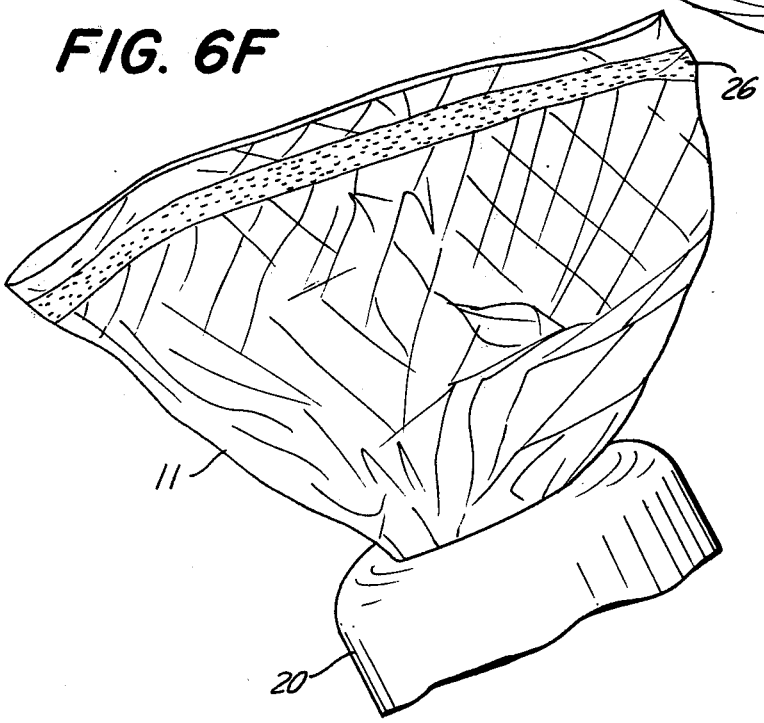
FIG. 6G

FIG. 10
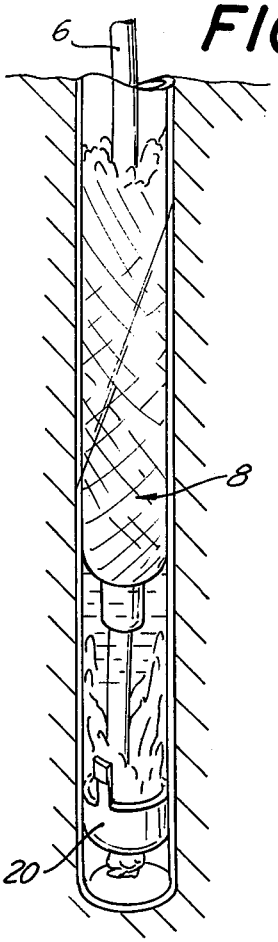
FIG. 11
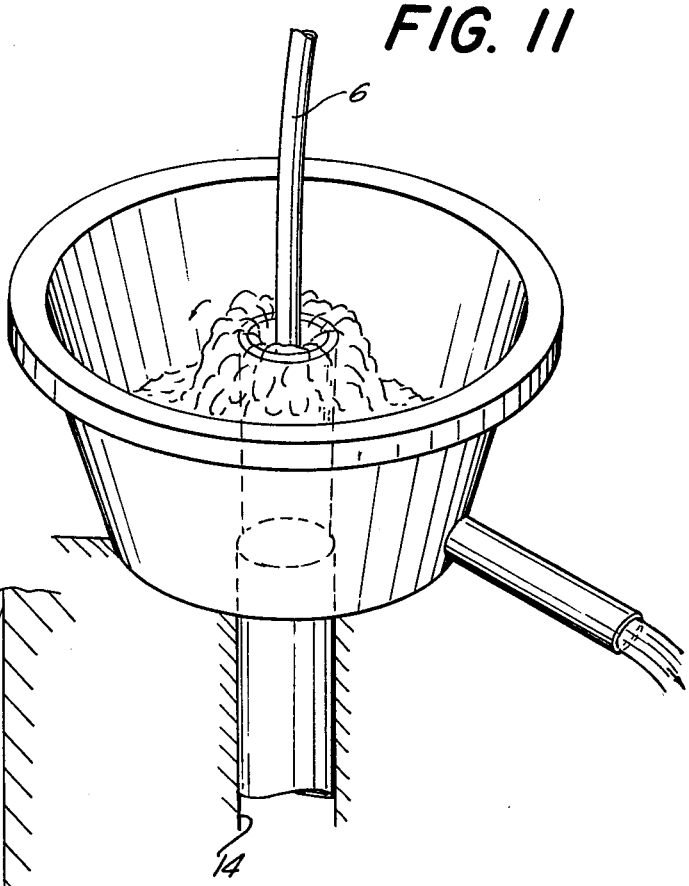
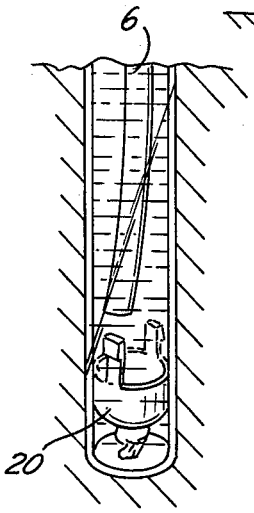
FIG. 14
FIG. 13
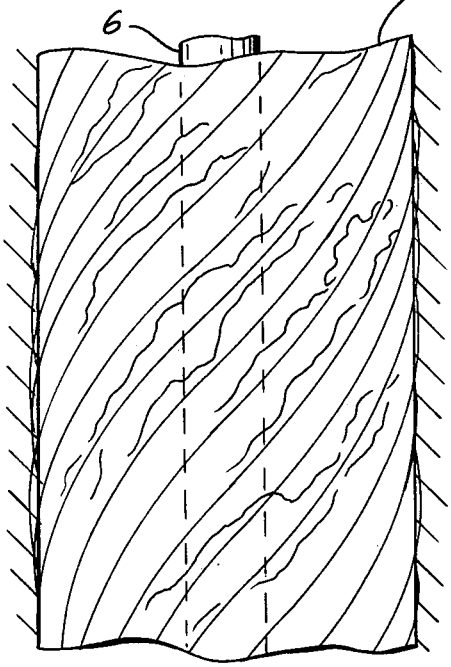
FIG. 12
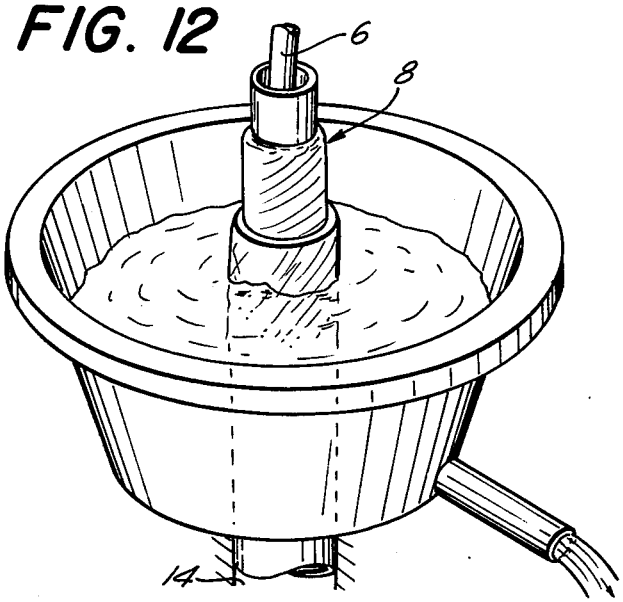

METHOD FOR THE PRODUCTION OF A CAVITY LIMITED BY A FLEXIBLE MATERIAL

FIELD OF THE INVENTION

The present invention relates to a method for the production of cavities of a certain length covered by a flexible material, which can consist of a tube-shaped cover made of plastic film. The tube-shaped cover has a number of different applications, not only for packages, such as packing of foods, as a joint filler for the building industry, etc., but even generally in order to produce a limited cavity.

BACKGROUND

One of the problems which is solved by the invention is within the explosives technology to remove water from a bore hole in a simple and inexpensive way, and to protect the explosive which is added to the bore hole from moisture. On the whole, the requirement often arises within the technical field to be able to separate a space from contact with the surrounding environment, e.g. casting.

SUMMARY OF THE INVENTION

The invention comprises a method for the production of such a separation under a number of different conditions.

The tube-shaped cover can advantageously be used in such a way that the purpose of the cover is not mainly enclose any medium but to shut out media, e.g. moisture or gases. Furthermore, the invention comprises a method where the cover, in addition to shutting out and/or shutting in media, is used to remove a non-desired medium, e.g. water or some type of gas from a certain space.

The tube-shaped cover, according to the invention, is stored by radially winding of itself in a number overlapping layers, so that the wound cover together with a possible bobbin, e.g. a tube, form a magazine. This technology is known from Swedish patent application No. 16,859/71 as well as others.

The cover stored in this way is suitably unwound by means of a pressure medium to the desired length, which can be effected in a number of ways. One can provide a magazine with or without bobbin, and in certain cases it is even suitable to place a runner in the form of a suitably adapted cover inside the magazine. The purpose of the runner is to facilitate a sliding and twisting movement along a pipe or bar, which is hereafter called a guide.

Part of the free end of the cover is pulled out and then this end, as well as any other openings, will be closed so that an enclosed cavity is formed. Pressure medium is supplied to the cavity so that the desired quantity of cover is unreeled from the magazine and unwound. If the pressure medium is supplied via the free end of the cover; the magazine is allowed to move in concurrence with the unwinding of the cover, and in this way the magazine can move freely and slide along a guide if guidance is desired. An alternative way to unwind the cover is to supply the pressure medium via the magazine, which in this connection can be placed on a pipe in such a way or arranged in such a way that the magazine and perhaps the pipe are allowed to rotate. In this way; the cover will be unwound by a rotary movement of either the cover or the magazine, or perhaps by both, so that the free end of the cover moves away from the magazine during the unwinding. Even for this alternative a guide can be used for guidance, as the guide is movably placed through the magazine, and the free end of the cover is arranged so that it can slide along the guide with a sufficiently good seal.

The guide can be arranged in such a way that the pressure medium for the unwinding of the cover can be supplied via the same. The cavity obtained in this way can even be filled with another desired medium via the same guide.

BRIEF DESCRIPTION OF THE DRAWINGS

FIG. 5 is a perspective view showing the mounting of a protective casing on the free end of the cover, FIG. 6D shows the cover with a fourth closure device;

FIG. 6E shows the cover with a fifth closure device,

FIG. 6F shows the cover with a sixth closure device,

FIG. 6G shows the cover with a seventh closure device,

FIG. 7 shows the magazine at the beginning of insertion in a tubular bore filled with water, FIG. 8 shows the magazine in the tubular bore during lowering of the magazine, FIG. 9 shows the magazine at the bottom of the tubular bore, FIG. 10 is similar to FIG. 9 and shows movement of the magazine along the guide when air is supplied through the guide, FIG. 11 shows the manner of displacement of the water from the bore when the magazine moves upwardly, FIG. 12 shows the magazine leaving the bore after the bore has been provided with an integral cover, FIG. 13 shows the bore with cover and guide, FIG. 14 shows the cavity in the bore with filling material therein.

DETAILED DESCRIPTION

Figure 1:
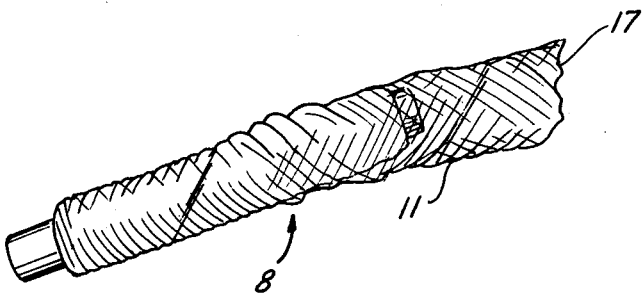
FIG. 1 is a perspective view of a magazine having a plastic cover which has been slightly pulled away from the magazine.
Figure 2:
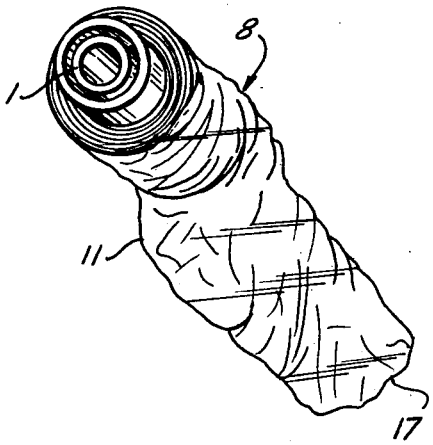
FIG. 2 is a front perspective view showing a runner inserted in the core of the magazine.

In FIG. 1, there is seen a magazine 8 containing a tubular cover 11. The tubular cover can be in the form of a plastic hose which can be stored in a number of different ways. A suitable way of storing the hose is to use the method which is mentioned in Swedish patent applicaton No. 16,859/71. The hose is pulled out a bit as appears in FIG. 1 so that a free end 17 is formed. The magazine is fastened in suitable manner on a runner 1, as shown in FIG. 2.

Figure 3:
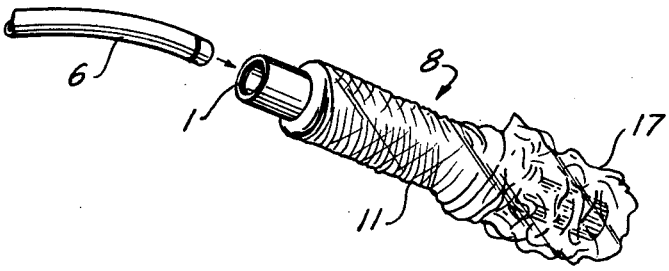
FIG. 3 is a view similar to FIG. 1 showing the insertion of a guide into the runner.
Figure 4:
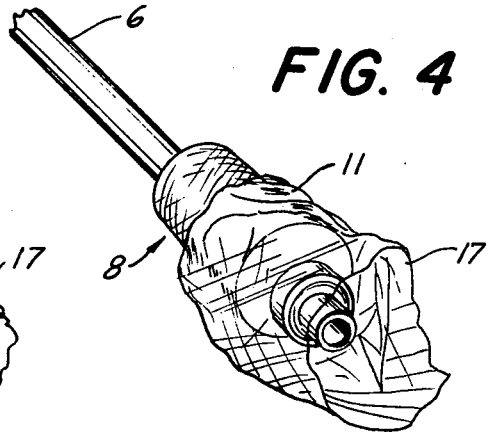
FIG. 4 is a front perspective view showing the hose inserted in place.
Figure 6:
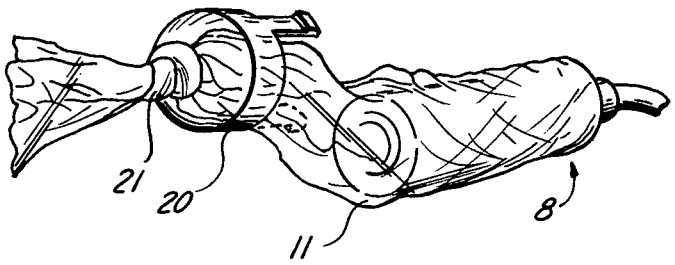
FIG. 6 shows the protective casing in mounted position with the free end of the cover tied and protruding from the casing.
Figure 6A:
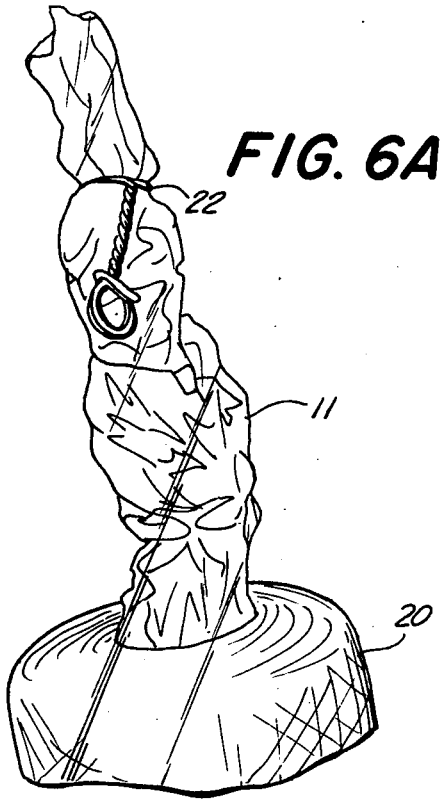
FIG. 6A shows the cover with a second embodiment of closure of the end of the cover.
Figure 6B:
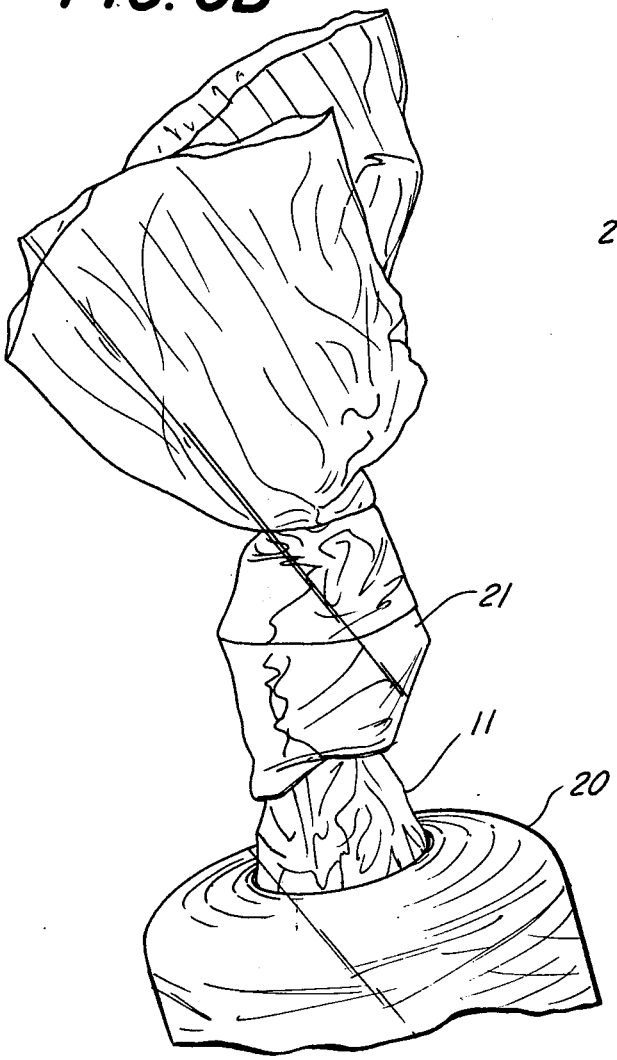
FIG. 6B shows the cover with closure device of FIG. 6 on enlarged scale.
Figure 6C:
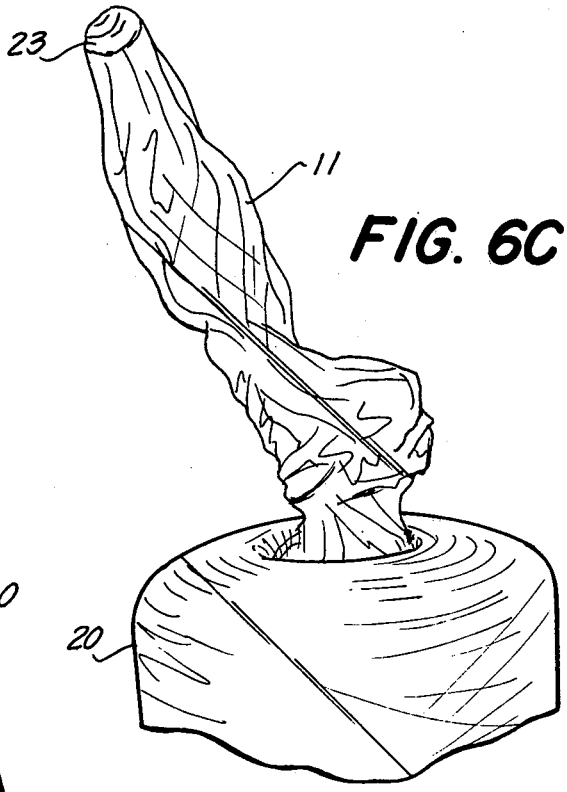
FIG. 6C shows the cover with a third closure device.

As appears from FIG. 3, a guide 6 is inserted in the unit consisting of the magazine with runner 1. The runner is made in such a way that the runner together with the magazine can slide along the guide. Between the runner and the guide are arranged sealing rings 2, 3 (FIG. 15) in order to prevent the passage of liquid or pressure medium. In FIG. 4 is shown the guide 6 in place in the runner 1 and the magazine 8. The runner and the magazine are in their starting positions in FIG. 4. It is suitable to allow the free end 17 of the cover 11 to be inserted through a casing 20, e.g. of the kind shown in FIG. 5. The purpose of the casing is to protect the following magazine, but if desired it can also be dispensed with. When the free end 17 of the hose has been pulled through the casing, the end is closed, which can take place according to FIG. 6 by means of a knot 21. The end can also be closed by means of a metal wire 22, as shown in FIG. 6 A. The utmost end of the cover in connection with such a seal can be melted so that a melt sealing 23 is formed as shown in FIG. 6 C the end can be sealed by a sealing substance 24 or the like, as shown in FIG. 6 D. The end can also be closed by means of a tubular part with outside thread, which cooperates with a cap 25 with inside thread in such a way that the free end of the hose is fixed between these threads as seen in FIG. 6 E. Another alternative is to provide the free end of the hose with a transverse weld 26, as shown in FIG. 6 F. The end closed in this way can also be provided with knot 21, as shown in FIG. 6 G.

The unit shown in FIG. 6, with magazine 8 and runner mounted on one end of guide 6, and with the cover closed at its free end, is inserted into a hole 14, as shown in FIG. 7. The insertion takes place down to the bottom of the hole. FIG. 8 shows the unit during its travel down towards the bottom of the hole, and FIG. 9 shows the unit when it has reached the bottom of the hole. When the unit rests upon the bottom, a pressure medium, such as pneumatic air, is supplied through the guide 6, which will make the runner and magazine move upwards along the guide 6, through the impact of the pressure medium the runner and magazine moving, towards the opening of the hole while the stored plastic hose is being unwound. This sequence takes place until the magazine with the remaining hose and runner leaves the hole, as shown in FIG. 12. In this situation there is in the hole only a pressed-out and unwound plastic hose and a guide. This appears in FIG. 13. At this step, one can start filling, for instance, explosives through the guide, and this is shown in FIG. 14.

When the hole is filled with water, the sequence described above will take place namely, during the unwinding of the hose the water is displaced and pressed out through the hole in the manner shown in FIGS. 8 to 13.

Figure 15:
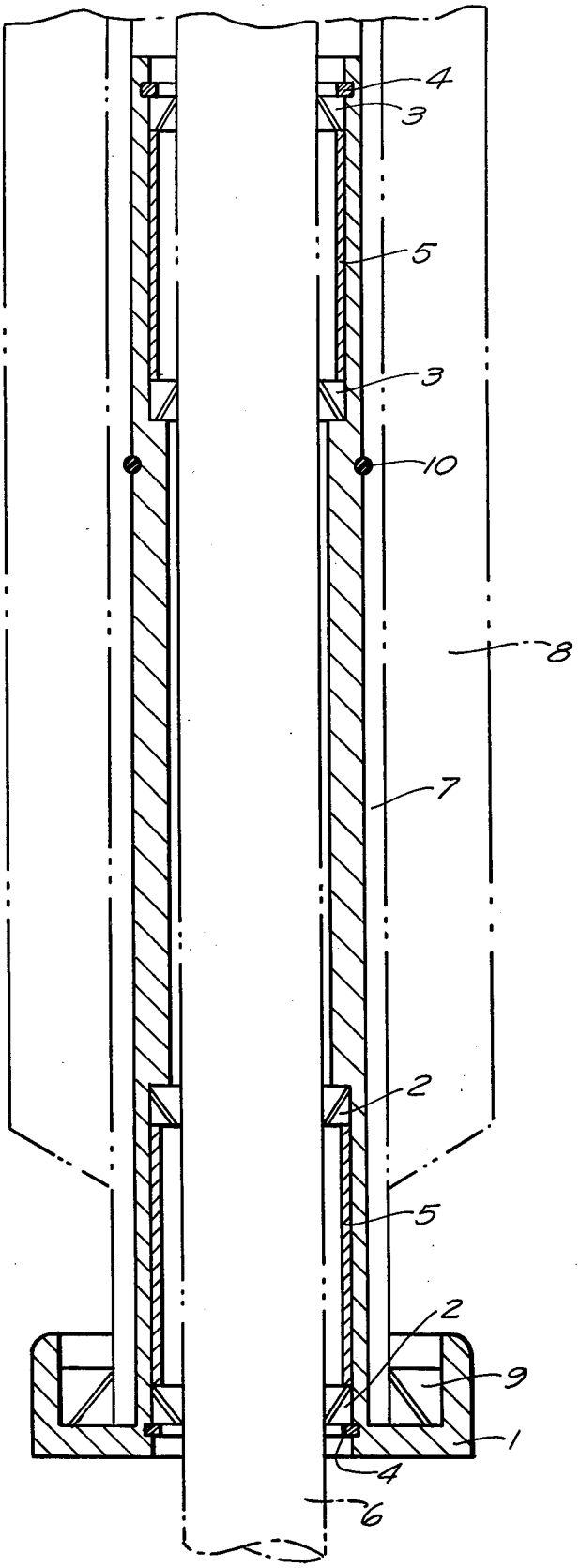
FIG. 15 is a longitudinal sectional view of a runner in the magazine.

In FIG. 15 is shown an embodiment of a runner 1 pulled upon a guide 6. In both ends of the runner are milled grooves where the sealing rings 2 and 3 are placed, the sealing rings being kept at a distance from each other by means of distance bushes 5. Each unit of two sealing rings and distance bushes is kept in place by means of snap rings 4. The sealing rings prevent the medium, e.g. water or pressure medium, from passing between the runner 1 and the guide 6. The runner 1 is inserted in a bobbin 7 of the magazine 8. The bobbin 7 is fastened to the runner 1 by means of a sealing ring 9 and by means of an O-ring 10.

Figure 16:
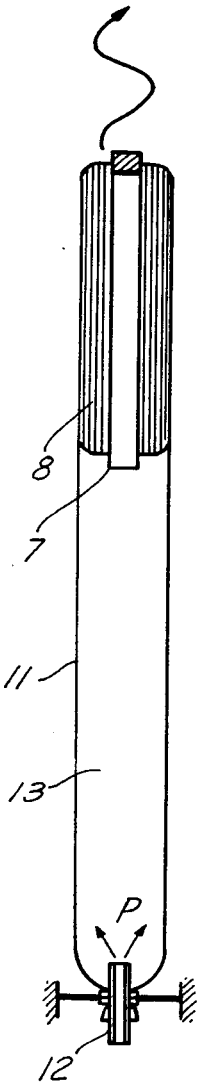
FIG. 16 shows a magazine in which pressure medium is supplied to the pulled out end of the cover.
Figure 17:
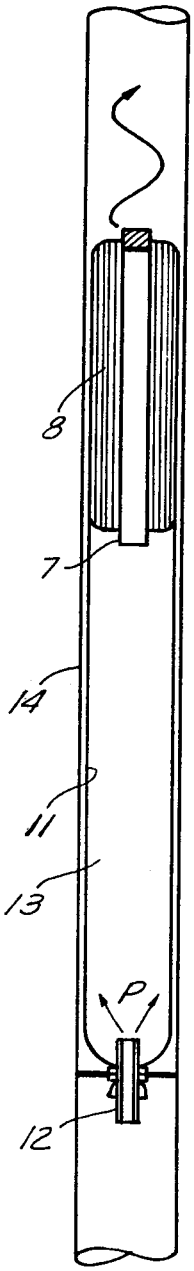
FIG. 17 is similar to FIG. 16 showing the cover unwound in a pipe.

FIGS. 16 and 17 show the tubular, flexible material 11 connected to a pressure medium via a coupling 12. The magazine is sealed so that an enclosed cavity 13 is formed. When the pressure medium is fed to cavity 13 and the pressure in the cavity exceeds the surrounding pressure, the cover of the magazine is unwound during relative movement between the coupling 12 and the magazine 8, which movement includes a rotary movement. The cover is unwound until the pressure reaches the same level as the pressure outside the system, or until the flexible material has become fully unreeled.

Through the rotation and the manner in which the tube-shaped cover is formed, each point of the unwound cover is going to take up a position in the hole which is not changed in connection with continued unwinding of the cover from the magazine.

FIG. 17 shows the formation of the hose-shaped cavity, which is guided at the outside by a cylinder 14. If the cylinder is homogeneous and tight, e.g. for gases or liquids, the growing hose-shaped cover can be considered to form a piston which can press gases, liquids or particles forwards in the direction away from the coupling 12.

In this way the hose-shaped cover can cover the inside of a duct or a pipe.

Figure 18:
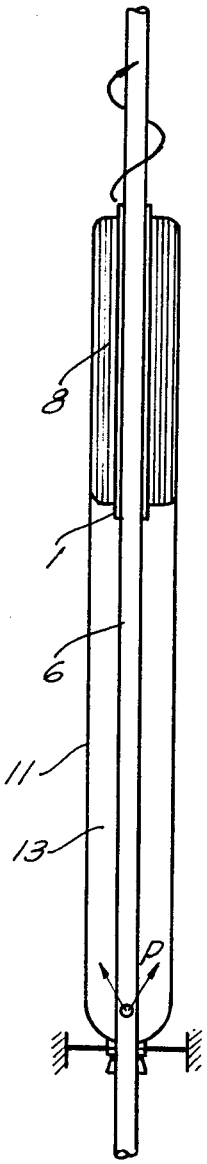
FIG. 18 is similar to FIG. 16 showing a guide extending through the magazine.

FIG. 18 shows a device corresponding to the one in FIG. 16, but in which the formation of the hose-shaped cavity is controlled at the inside by the magazine, which slides along guide 6.

Figure 19:
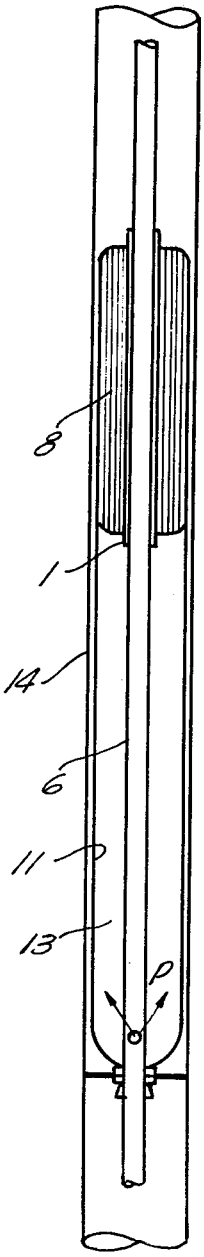
FIG. 19 is similar to FIG. 18 with the magazine unwound in a pipe.

FIG. 19 shows a device which corresponds in principle to FIGS. 16 and 17, but where the movement of the magazine is controlled both at the outside and at the inside.

Figure 20:
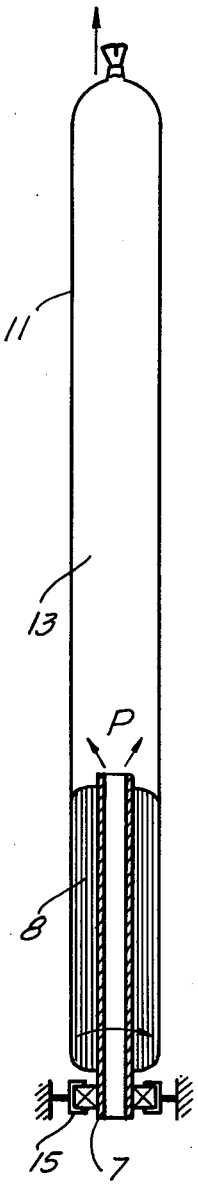
FIG. 20 shows the magazine with a pulled out cover and with pressure medium supplied to the magazine.

FIG. 20 shows the radially wound cover wound upon bobbin 7, which is fastened in a support 15 so that the magazine can rotate freely, the support 15 being in a plane at right angle to the longitudinal direction of the magazine. When the cover is closed and pressure medium is supplied, a hose-shaped cavity 13 is formed, as shown in FIG. 20. The cover rotates during the unwinding if this movement is not fully compensated by rotation in the support 15.

Figure 21:
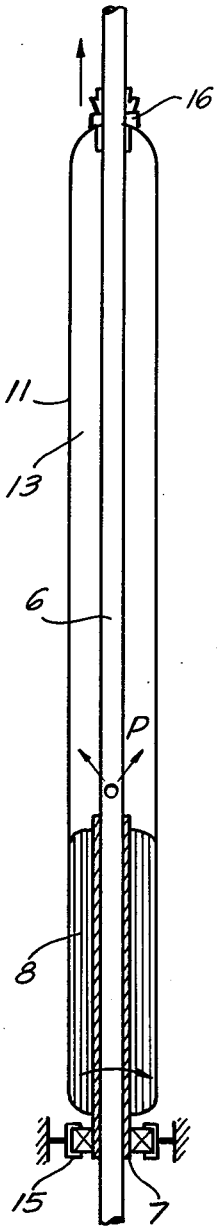
FIG. 21 is similar to FIG. 20 but with a guide for supply of pressure medium.

FIG. 21 shows a device corresponding to the one in FIG. 20, but in which the formation of the hose-shaped cavity is controlled such that the bobbin 7 of the magazine can rotate and/or move along guide 6, and that the hose-shaped flexible material is closed round a bush 16, which can also rotate and/or move freely along the guide.

A unit consisting of the magazine 8 with or without the runner 1 can be used for externally covering a tube with plastic hose. In this case, one end of the tube which is to be provided with the cover is inserted in the runner or the magazine. In this way the end of the tube turning towards the magazine is closed. The free end of the hose is pulled out to a sufficient degree and fastened to a nozzle which can supply pressure medium. When this takes place the runner or the pipe of the magazine will slide along the tube and cover the same with the plastic hose. This sequence is in principle in accordance with the showing in FIG. 18.

The present invention is suitable for lining bore holes in rocks, which are to be filled with explosives. By this invention, the explosive is prevented from coming into contact with any water, which can be admitted into the bore hole because of cracks or the like. It can also be used to prevent explosives from being admitted into pockets or cavities in the rock. In connection with the adaption in the bore hole, the magazine is directly placed on a supply hose which serves as guide 6 is or indirectly placed on the hose through a runner 1. Then the free end of the cover is closed. The supply hose and magazine is inserted into the bottom of the hole, and air is supplied through the supply hose. The magazine, with or without runner, is then going to slide upwards along the supply hose to the opening of the hole, and at the same time the cover is unwound in the hole. When the bore hole is fully lined with plastic film, the bore hole can be filled with explosives via the supply hose, which is successively pulled up from the bore hole as the bore hole has become filled with explosives. If the bore hole is fully or partly filled with water this is discharged concurrently with the unwinding of the cover in the manner described earlier. In connection with the unwinding of the cover, each part of the cover comes into contact with only one point in the bore hole. This gives the advantage that a material with thin walls can be used as it is not torn due to movement against sharp and rough surfaces in the bore hole. The invention is also suitable for use, for instance, in connection with casting under water, for which a relatively simpler shape construction can be used. The shape is lined at the inside with plastic hose in the manner described, and therefore the water is displaced and the casting can be made.

What is claimed is:

1. A method for lining a vertical bore hole in the ground with a tubular length of material and for removing any liquid present in the bore hole, said method comprising providing a magazine having a substantial length of tubular material radially wound on itself in a number of overlapping layers, pulling one end of tubular material from the magazine, closing said end to form a tubular cavity within the portion of the tubular material pulled from the magazine, inserting the magazine into the bore hole to the bottom thereof, supplying a pressure medium to said tubular cavity to unwind said material from the magazine while propelling the magazine upwardly through said bore hole, said material which is being unwound being pressurized by said pressure medium to fit tightly against the wall of the bore hole such that as the magazine advances upwardly any liquid present in the bore hole is expelled from the open top of the bore hold.

2. A method as claimed in claim 1 wherein said magazine has an open end, said pressure medium being supplied to said cavity through said open end.

3. A method as claimed in claim 1 comprising slidably mounting said magazine on a tubular guide through which said pressure medium is supplied to said cavity so that during unwinding said magazine is propelled along said guide.

4. A method as defined in claim 3 comprising sealing said magazine on said guide.

5. A method as defined in claim 3 comprising filling the lined bore with material via said guide.

6. A method as defined in claim 1 wherein said end of the tubular material is closed by passing said end through an opening in a protective cap and closing said end.

7. A method as claimed in claim 1 wherein due to the radial winding of the material on said magazine, the magazine undergoes rotation as it is being propelled upwardly in said bore hole.

8. A method as claimed in claim 1 comprising placing a basin at the upper open end of the bore hole, the basin having an opening through which the magazine is inserted to the bottom of the hole, the liquid expelled from the bore hole during upward propulsion of the magazine being recovered in said basin and externally discharged therefrom.

* * * * *